US008112921B2

(12) United States Patent
Van De Ven et al.

(10) Patent No.: US 8,112,921 B2
(45) Date of Patent: Feb. 14, 2012

(54) SIGN AND METHOD FOR LIGHTING

(75) Inventors: Antony Paul Van De Ven, Hong Kong (HK); Gerald H. Negley, Durham, NC (US)

(73) Assignee: Cree, Inc., Durham, NC (US)

( * ) Notice: Subject to any disclaimer, the term of this patent is extended or adjusted under 35 U.S.C. 154(b) by 982 days.

(21) Appl. No.: 11/613,733

(22) Filed: Dec. 20, 2006

(65) Prior Publication Data

US 2007/0137074 A1 Jun. 21, 2007

Related U.S. Application Data

(60) Provisional application No. 60/752,556, filed on Dec. 21, 2005.

(51) Int. Cl.

| | |
|---|---|
| ***G09F 13/00*** | (2006.01) |
| ***G09G 3/36*** | (2006.01) |
| ***G09G 5/10*** | (2006.01) |
| ***G09G 5/00*** | (2006.01) |

(52) U.S. Cl. ..... 40/581; 345/655; 345/88; 345/690; 362/231; 362/260

(58) Field of Classification Search ..... 40/581
See application file for complete search history.

(56) References Cited

U.S. PATENT DOCUMENTS

| | | | | |
|---|---|---|---|---|
| 3,122,670 | A * | 2/1964 | Rudatis | 313/473 |
| 5,726,535 | A | 3/1998 | Yan | |
| 5,808,592 | A | 9/1998 | Mizutani et al. | |
| 6,262,710 | B1 | 7/2001 | Smith | |
| 6,621,211 | B1 | 9/2003 | Srivastava et al. | |
| 7,235,792 | B2 * | 6/2007 | Elofson | 250/461.1 |
| 7,518,584 | B2 * | 4/2009 | Heynderickx et al. | 345/88 |
| 2003/0156425 | A1 | 8/2003 | Turnbull et al. | |
| 2004/0008283 | A1 * | 1/2004 | Yang et al. | 348/656 |
| 2004/0090180 | A1 | 5/2004 | Shimizu et al. | |
| 2005/0127381 | A1 | 6/2005 | Vitta et al. | |
| 2005/0200295 | A1 | 9/2005 | Lim et al. | |
| 2005/0212404 | A1 | 9/2005 | Chen et al. | |
| 2006/0208642 | A1 | 9/2006 | Baier et al. | |

FOREIGN PATENT DOCUMENTS

| | | |
|---|---|---|
| EP | 1 526 057 | 4/2005 |
| WO | 2004/093125 | 10/2004 |
| WO | 2004/107018 | 12/2004 |
| WO | 2005/096258 | 10/2005 |

OTHER PUBLICATIONS

U.S. Appl. No. 11/613,692, filed Dec. 20, 2006.
U.S. Appl. No. 11/613,714, filed Dec. 20, 2006.

* cited by examiner

*Primary Examiner* — Joanne Silbermann
*Assistant Examiner* — Syed A Islam
(74) *Attorney, Agent, or Firm* — Burr & Brown

(57) ABSTRACT

A sign comprising a surface having a display, and a plurality of sources of visible light. The sources of visible light are oriented to illuminate at least a portion of the display, and include solid state light emitters and/or luminescent materials. Line segments drawn on a Chromaticity Diagram connecting coordinates of some of the illumination color hues define a shape which encompasses coordinates of the display color hue(s). Also, a sign comprising a surface having a display having a surface area of at least 4 square meters, and at least 100 sources of visible light including solid state light emitters and/or luminescent materials. Also, a sign comprising a white light source and at least one additional source of light. Also, methods of illuminating signs.

79 Claims, 5 Drawing Sheets

SIGN AND METHOD FOR LIGHTING

CROSS-REFERENCE TO RELATED APPLICATIONS

This application claims the benefit of U.S. Provisional Patent Application No. 60/752,556, filed Dec. 21, 2005, the entirety of which is incorporated herein by reference.

FIELD OF THE INVENTION

The present invention relates to a sign, in particular, a large sign having a display with one or more colors, and lights for illuminating the sign. In a preferred aspect, the present invention relates to a billboard or a roadway sign which is illuminated with lighting which includes one or more solid state light emitters, e.g., one or more light emitting diodes, and/or one or more luminescent materials (such as a luminescent element comprising one or more phosphor materials).

BACKGROUND OF THE INVENTION

A large proportion (some estimates are as high as one third) of the electricity generated in the United States each year goes to lighting. Accordingly, there is an ongoing need to provide lighting which is more energy-efficient. It is well-known that incandescent light bulbs are very energy-inefficient light sources—about ninety percent of the electricity they consume is released as heat rather than light. Fluorescent light bulbs are more efficient than incandescent light bulbs (by a factor of about 4) but are still quite inefficient as compared to solid state light emitters, such as light emitting diodes.

In addition, as compared to the normal lifetimes of solid state light emitters, incandescent light bulbs have relatively short lifetimes, i.e., typically about 750-1000 hours. In comparison, the lifetime of light emitting diodes, for example, can generally be measured in decades. Fluorescent bulbs have longer lifetimes (e.g., 10,000-20,000 hours) than incandescent lights, but provide less favorable color reproduction. Color reproduction is typically measured using the Color Rendering Index (CRI) which is a relative measure of the shift in surface color of an object when lit by a particular lamp. Daylight has the highest CRI (of 100), with incandescent bulbs being relatively close (about 95), and fluorescent lighting being less accurate (70-85). Certain types of specialized lighting have relatively low CRI's (e.g., mercury vapor or sodium, both as low as about 40 or even lower).

Another issue faced by conventional light fixtures is the need to periodically replace the lighting devices (e.g., light bulbs, etc.). Such issues are particularly pronounced where access is difficult (e.g., vaulted ceilings, bridges, high buildings, traffic tunnels) and/or where change-out costs are extremely high. The typical lifetime of conventional fixtures is about 20 years, corresponding to a light-producing device usage of at least about 44,000 hours (based on usage of 6 hours per day for 20 years). Light-producing device lifetime is typically much shorter, thus creating the need for periodic change-outs.

Accordingly, for these and other reasons, efforts have been ongoing to develop ways by which solid state light emitters can be used in place of incandescent lights, fluorescent lights and other light-generating devices in a wide variety of applications. In addition, where light emitting diodes (or other solid state light emitters) are already being used, efforts are ongoing to provide light emitting diodes (or other solid state light emitters) which are improved, e.g., with respect to energy efficiency, color rendering index (CRI), efficacy (1 m/W), and/or duration of service.

A variety of solid state light emitters are well-known. For example, one type of solid state light emitter is a light emitting diode. Light emitting diodes are well-known semiconductor devices that convert electrical current into light. A wide variety of light emitting diodes are used in increasingly diverse fields for an ever-expanding range of purposes.

More specifically, light emitting diodes are semiconducting devices that emit light (ultraviolet, visible, or infrared) when a potential difference is applied across a p-n junction structure. There are a number of well-known ways to make light emitting diodes and many associated structures, and the present invention can employ any such devices. By way of example, Chapters 12-14 of Sze, Physics of Semiconductor Devices, (2d Ed. 1981) and Chapter 7 of Sze, Modern Semiconductor Device Physics (1998) describe a variety of photonic devices, including light emitting diodes.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

As is well-known, a light emitting diode produces light by exciting electrons across the band gap between a conduction band and a valence band of a semiconductor active (light-emitting) layer. The electron transition generates light at a wavelength that depends on the band gap. Thus, the color of the light (wavelength) emitted by a light emitting diode depends on the semiconductor materials of the active layers of the light emitting diode.

Although the development of light emitting diodes has in many ways revolutionized the lighting industry, some of the characteristics of light emitting diodes have presented challenges, some of which have not yet been fully met. For example, the emission spectrum of any particular light emitting diode is typically concentrated around a single wavelength (as dictated by the light emitting diode's composition and structure), which is desirable for some applications, but not desirable for others, (e.g., for providing lighting, such an emission spectrum provides a very low CRI).

Because light that is perceived as white is necessarily a blend of light of two or more colors (or wavelengths), no single light emitting diode can produce white light. "White" light emitting diodes have been produced which have a light emitting diode pixel formed of respective red, green and blue light emitting diodes. Other "white" light emitting diodes have been produced which include (1) a light emitting diode which generates blue light and (2) a luminescent material (e.g., a phosphor) that emits yellow light in response to excitation by light emitted by the light emitting diode, whereby the blue light and the yellow light, when mixed, produce light that is perceived as white light.

In addition, the blending of primary colors to produce combinations of non-primary colors is generally well understood in this and other arts. In general, the 1931 CIE Chromaticity Diagram (an international standard for primary colors established in 1931), and the 1976 CIE Chromaticity Diagram (similar to the 1931 Diagram but modified such that similar distances on the Diagram represent similar perceived differences in color) provide useful reference for defining colors as weighted sums of primary colors.

Light emitting diodes can thus be used individually or in any combinations, optionally together with one or more luminescent material (e.g., phosphors or scintillators) and/or filters, to generate light of any desired perceived color (including white). Accordingly, the areas in which efforts are being made to replace existing light sources with light emitting diode light sources, e.g., to improve energy efficiency, color rendering index (CRI), efficacy (lm/W), and/or duration of service, are not limited to any particular color or color blends of light.

A wide variety of luminescent materials (also known as lumiphors or luminophoric media, e.g., as disclosed in U.S. Pat. No. 6,600,175, the entirety of which is hereby incorporated by reference) are well-known and available to persons of skill in the art. For example, a phosphor is a luminescent material that emits a responsive radiation (e.g., visible light) when excited by a source of exciting radiation. In many instances, the responsive radiation has a wavelength which is different from the wavelength of the exciting radiation. Other examples of luminescent materials include scintillators, day glow tapes and inks which glow in the visible spectrum upon illumination with ultraviolet light.

Luminescent materials can be categorized as being down-converting, i.e., a material which converts photons to a lower energy level (longer wavelength) or up-converting, i.e., a material which converts photons to a higher energy level (shorter wavelength).

Inclusion of luminescent materials in LED devices has been accomplished by adding the luminescent materials to a clear encapsulant material (e.g., epoxy-based or silicone-based material) as discussed above, for example by a blending or coating process.

For example, U.S. Pat. No. 6,963,166 (Yano '1166) discloses that a conventional light emitting diode lamp includes a light emitting diode chip, a bullet-shaped transparent housing to cover the light emitting diode chip, leads to supply current to the light emitting diode chip, and a cup reflector for reflecting the emission of the light emitting diode chip in a uniform direction, in which the light emitting diode chip is encapsulated with a first resin portion, which is further encapsulated with a second resin portion. According to Yano '166, the first resin portion is obtained by filling the cup reflector with a resin material and curing it after the light emitting diode chip has been mounted onto the bottom of the cup reflector and then has had its cathode and anode electrodes electrically connected to the leads by way of wires. According to Yano '166, a phosphor is dispersed in the first resin portion so as to be excited with the light A that has been emitted from the light emitting diode chip, the excited phosphor produces fluorescence ("light B") that has a longer wavelength than the light A, a portion of the light A is transmitted through the first resin portion including the phosphor, and as a result, light C, as a mixture of the light A and light B, is used as illumination.

As noted above, "white LED lights" (i.e., lights which are perceived as being white or near-white) have been investigated as potential replacements for white incandescent lamps. A representative example of a white LED lamp includes a package of a blue light emitting diode chip, made of gallium nitride (GaN), coated with a phosphor such as YAG. In such an LED lamp, the blue light emitting diode chip produces an emission with a wavelength of about 450 μm, and the phosphor produces yellow fluorescence with a peak wavelength of about 550 μm on receiving that emission. For instance, in some designs, white light emitting diodes are fabricated by forming a ceramic phosphor layer on the output surface of a blue light-emitting semiconductor light emitting diode. Part of the blue ray emitted from the light emitting diode chip passes through the phosphor, while part of the blue ray emitted from the light emitting diode chip is absorbed by the phosphor, which becomes excited and emits a yellow ray. The part of the blue light emitted by the light emitting diode which is transmitted through the phosphor is mixed with the yellow light emitted by the phosphor. The viewer perceives the mixture of blue and yellow light as white light.

As also noted above, in another type of LED lamp, a light emitting diode chip that emits an ultraviolet ray is combined with phosphor materials that produce red (R), green (G) and blue (B) light rays. In such an "RGB LED lamp", the ultraviolet ray that has been radiated from the light emitting diode chip excites the phosphor, causing the phosphor to emit red, green and blue light rays which, when mixed, are perceived by the human eye as white light. Consequently, white light can also be obtained as a mixture of these light rays.

Designs have been provided in which existing LED component packages and other electronics are assembled into a fixture. In such designs, a packaged LED product is mounted to a circuit board, the circuit board is mounted to a heat sink, and the heat sink is mounted to the fixture housing along with required drive electronics. In many cases, additional optics (secondary to the package parts) are also necessary.

In substituting light emitting diodes for other light sources, e.g., incandescent light bulbs, packaged LEDs have been used with conventional light fixtures, for example, fixtures which include a hollow lens and a base plate attached to the lens, the base plate having a conventional socket housing with one or more contacts which are electrically coupled to a power source. For example, LED light bulbs have been constructed which comprise an electrical circuit board, a plurality of packaged LEDs mounted to the circuit board, and a connection post attached to the circuit board and adapted to be connected to the socket housing of the light fixture, whereby the plurality of LEDs can be illuminated by the power source.

There is an ongoing need for ways to use solid state light emitters, e.g., light emitting diodes, to provide white light in a wider variety of applications, with greater energy efficiency, with improved color rendering index (CRI), with improved contrast, with improved efficacy (lm/W), and/or with longer duration of service.

BRIEF SUMMARY OF THE INVENTION

In one aspect of the present invention, there is provided a sign which comprises a display having one or more color hues, and a plurality of sources of visible light for illuminating the display, the sources of visible light being selected from among solid state light emitters and luminescent materials and providing excellent color rendering and contrast for the sign.

In a specific aspect, the present invention provides effective lighting for comparatively large signs, e.g., billboards and/or roadway signage.

Preferably, in this aspect of the present invention, the sign includes sources of visible light which emit light having respective x,y coordinates on the 1931 CIE Chromaticity Diagram, the respective x,y coordinates, when connected by line segments, defining a shape which encompasses the respective x,y coordinates for each of the color hues on the display, whereby all of the color hues on the display can be illuminated effectively.

In another aspect of the present invention, there is provided a sign which comprises a display which has one or more color hues and which is comparatively large, and a large number of sources of visible light for illuminating the display, the sources of visible light being selected from among solid state light emitters and luminescent materials and including at least one light emitting diode having a relatively small illumination surface.

In another aspect of the present invention, there is provided a sign which comprises a display having one or more color hues, a white light source for illuminating the sign, the white light source having a CRI of 75 or less, and one or more additional sources of visible light for enhancing the CRI of the white light source, the one or more additional sources of visible light being selected from among solid state light emitters and luminescent materials.

In additional aspects of the present invention, lighting as described herein is used to illuminate signage.

In another aspect of the present invention, there is provided a sign comprising a display having one or more color hues, and a plurality of sources of visible light for illuminating the display, in which illuminations from two or more sources of visible light which, if mixed in the absence of any other light, would produce a combined illumination which would be perceived as white or near-white, is mixed with illumination from one or more additional sources of visible light, each of the sources of visible light being independently selected from among solid state light emitters and luminescent materials. In a specific aspect of the present invention, the illumination from the mixture of light thereby produced is on or near the blackbody locus on the 1931 CIE Chromaticity Diagram (or on the 1976 CIE Chromaticity Diagram).

In the discussion relating to this aspect of the present invention, the two or more sources of visible light which produce light which, if combined in the absence of any other light, would produce an illumination which would be perceived as white or near-white are referred to herein as "white light generating sources." The one or more additional sources of visible light referred to above are referred to herein as "additional light sources."

The respective sources of visible light can each independently be saturated or non-saturated. The term "saturated", as used herein, means having a purity of at least 85%, the term "purity" having a well-known meaning to persons skilled in the art, and procedures for calculating purity being well-known to those of skill in the art.

Aspects of the present invention can be represented on either the 1931 CIE (Commission International de I'Eclairage) Chromaticity Diagram or the 1976 CIE Chromaticity Diagram. FIG. 1 shows the 1931 CIE Chromaticity Diagram. FIG. 2 shows the 1976 Chromaticity Diagram. FIG. 3 shows an enlarged portion of the 1976 Chromaticity Diagram, in order to show the blackbody locus in more detail. Persons of skill in the art are familiar with these diagrams, and these diagrams are readily available (e.g., by searching "CIE Chromaticity Diagram" on the internet).

The CIE Chromaticity Diagrams map out the human color perception in terms of two CIE parameters x and y (in the case of the 1931 diagram) or u' and v' (in the case of the 1976 diagram). For a technical description of CIE chromaticity diagrams, see, for example, "Encyclopedia of Physical Science and Technology", vol. 7, 230-231 (Robert A Meyers ed., 1987). The spectral colors are distributed around the edge of the outlined space, which includes all of the hues perceived by the human eye. The boundary line represents maximum saturation for the spectral colors. As noted above, the 1976 CIE Chromaticity Diagram is similar to the 1931 Diagram, except that the 1976 Diagram has been modified such that similar distances on the Diagram represent similar perceived differences in color.

In the 1931 Diagram, deviation from a point on the Diagram can be expressed either in terms of the coordinates or, alternatively, in order to give an indication as to the extent of the perceived difference in color, in terms of MacAdam ellipses. For example, a locus of points defined as being ten MacAdam ellipses from a specified hue defined by a particular set of coordinates on the 1931 Diagram consists of hues which would each be perceived as differing from the specified hue to a common extent (and likewise for loci of points defined as being spaced from a particular hue by other quantities of MacAdam ellipses).

Since similar distances on the 1976 Diagram represent similar perceived differences in color, deviation from a point on the 1976 Diagram can be expressed in terms of the coordinates, u' and v', e.g., distance from the point=$(\Delta u'^2+\Delta v'^2)^{1/2}$, and the hues defined by a locus of points which are each a common distance from a specified hue consist of hues which would each be perceived as differing from the specified hue to a common extent.

The chromaticity coordinates and the CIE chromaticity diagrams illustrated in FIGS. 1-3 are explained in detail in a number of books and other publications, such as pages 98-107 of K. H. Butler, "Fluorescent Lamp Phosphors" (The Pennsylvania State University Press 1980) and pages 109-110 of G. Blasse et al., "Luminescent Materials" (Springer-Veilag 1994), both incorporated herein by reference.

The chromaticity coordinates (i.e., color points) that lie along the blackbody locus obey Planck's equation: $E(\lambda)=A\lambda^{-5}/(e^{(B/T)}-1)$, where E is the emission intensity, λ is the emission wavelength, T the color temperature of the blackbody and A and B are constants. Color coordinates that lie on or near the blackbody locus yield pleasing white light to a human observer. The 1976 CIE Diagram includes temperature listings along the blackbody locus. These temperature listings show the color path of a blackbody radiator that is caused to increase to such temperatures. As a heated object becomes incandescent, it first glows reddish, then yellowish, then white, and finally blueish. This occurs because the wavelength associated with the peak radiation of the blackbody radiator becomes progressively shorter with increased temperature, consistent with the Wien Displacement Law. Illuminants which produce light which is on or near the blackbody locus can thus be described in terms of their color temperature.

Also depicted on the 1976 CIE Diagram are designations A, B, C, D and E, which refer to light produced by several standard illuminants correspondingly identified as illuminants A, B, C, D and E, respectively.

CRI is a relative measurement of how the color rendition of an illumination system compares to that of a blackbody radiator. The CRI equals 100 if the color coordinates of a set of test colors being illuminated by the illumination system are the same as the coordinates of the same test colors being irradiated by the blackbody radiator.

There exist "white" LED light sources which are relatively efficient but have a poor color rendering, typically less then 75, and which are particularity deficient in the rendering of red colors and also to a significant extent deficient in green. This means that many things, including the typical human complexion, food items, labeling, painting, posters, signs, apparel, home decoration, plants, flowers, automobiles, etc. exhibit odd or wrong color as compared to being illuminated with an incandescent light or natural daylight.

So called "warm white" LEDs have a more acceptable color temperature for indoor use, and good CRI, but their efficiency is much less then half that of the standard "white" LEDs.

Colored objects illuminated by RGB LED lamps frequently do not appear in their true colors. For example, an object that reflects only yellow light, and thus that appears to be yellow when illuminated with white light, will appear black when illuminated with light having an apparent yellow color, produced by the red and green LEDs of an RGB LED fixture. Such fixtures, therefore, are considered to provide poor color rendition, particularly when illuminating various settings such as a theater stage, television set, building interior, or display window.

There is therefore a need for a high efficiency solid-state white light source that combines the efficiency and long life of white LEDs with an acceptable color temperature and good color rendering index, good contrast and a wide gamut.

In accordance with an aspect of the present invention, there is provided a sign comprising a sign structure and a plurality of sources of visible light. In this aspect of the present invention, the sign structure has a first surface on which a display is positioned. The display comprises at least one display color hue, each display color hue having x,y coordinates on the 1931 CIE Chromaticity Diagram. The sources of visible light are oriented such that when illuminated, they each illuminate at least a portion of the display. The sources of visible light are each independently selected from among solid state light emitters and luminescent materials. Each source of visible light, when illuminated, emits light of an illumination color hue, each illumination color hue having x,y coordinates on the 1931 CIE Chromaticity Diagram. The sources of visible light are selected such that line segments drawn on the 1931 CIE Chromaticity Diagram connecting respective x,y coordinates of some or all of the illumination color hues define a shape which encompasses x,y coordinates of each display color hue. Accordingly, the gamut of the color of the light emitted by the sources of visible light fully encompasses the gamut of the color of the display.

In accordance with another aspect of the present invention, there is provided a sign (e.g., a roadway sign) comprising a sign structure and at least 100 sources of visible light. In this aspect of the present invention, the sign structure has a first surface on which a display is positioned. The display comprises at least one display color hue and has a surface area of at least 4 square meters. The sources of visible light are oriented such that when illuminated, they each illuminate at least a portion of the display. The sources of visible light are independently selected from among solid state light emitters and luminescent materials. The sources of visible light comprise at least one light emitting diode having an illumination surface having a surface area of not more than 0.25 $mm^2$.

For a larger area display, in accordance with another aspect of the present invention, there is provided a sign (e.g., a billboard) comprising a sign structure and at least 1000 sources of visible light (or, in some embodiments, at least 2000). In this aspect of the present invention, the sign structure has a first surface on which a display is positioned. The display comprises at least one display color hue and has a surface area of at least 40 square meters. The sources of visible light are oriented such that when illuminated, they each illuminate at least a portion of the display. The sources of visible light are independently selected from among solid state light emitters and luminescent materials. The sources of visible light comprise at least one light emitting diode having an illumination surface having a surface area of not more than 0.25 $mm^2$.

As noted above, one aspect of the present invention involves the use of LEDs having an illumination surface of limited size. Additionally, where there are more emitters per unit area, these light emitters can be manufactured at a reduced cost. For example, with LEDs which are ~⅓ the area (or so) of power LEDs with respect to the "chip/dice" size, the impact of defects greatly affects the yield (and hence the cost) of the fabricated wafer upon which the discrete LEDs are manufactured. For example, the table below shows the influence of "killer defects" on the LED yield.

| Killer Defect Loss (%) | Standard LED Yield (%) | Power Chip LED Yield (%) |
|---|---|---|
| 10 | 90 | 9 |
| 7 | 93 | 37 |
| 5 | 95 | 45 |
| 3 | 97 | 59 |
| 2 | 9 | 82 |
| 1 | 99 | 91 |

A "killer defect" is defined as any defect that renders that "useable area" dead. Hence, it now is obvious that even a small number of defects can vastly increase the cost of the LED dice component.

In accordance with another aspect of the present invention, there is provided a sign comprising a sign structure, a white light source and at least one additional source of visible light. In this aspect of the present invention, the sign structure has a first surface on which a display is positioned. The white light source has a CRI of 75 or less, and is oriented such that when illuminated, it illuminates at least a portion of the display. The at least one additional source of visible light is/are oriented such that when illuminated, it/they each illuminate at least a portion of the display. The at least one additional source of visible light is selected from among solid state light emitters and luminescent materials. The additional source(s) of visible light are selected such that mixing of light from the white light source and light from the at least one additional source of visible light produces a mixed illumination which has a CRI of at least 85 (in some embodiments, at least 90).

In accordance with another aspect of the present invention, there is provided a sign comprising a sign structure, a white light source and a plurality of additional sources of visible light. In this aspect of the present invention, the sign structure has a first surface on which a display is positioned. The display comprises at least one display color hue, each display color hue having x,y coordinates on a 1931 CIE Chromaticity Diagram. The white light source has a CRI of 75 or less. The white light source is oriented such that when illuminated, it illuminates at least a portion of the display. The additional sources of visible light are oriented such that when illuminated, they each illuminate at least a portion of the display. The additional sources of visible light are each independently selected from among solid state light emitters and luminescent materials. Each source of visible light, when illuminated, emits light of an illumination color hue, each illumination color hue having x,y coordinates on the 1931 CIE Chromaticity Diagram. The additional sources of visible light are selected such that line segments drawn on the 1931 CIE Chromaticity Diagram connecting respective x,y coordinates of some or all of the illumination color hues define a shape which encompasses x,y coordinates of each of the at least one display color hue. Accordingly, the gamut of the color of the light emitted by the sources of visible light fully encompasses the gamut of the color of the display.

In accordance with additional aspects of the present invention, there are provided methods in which a sign is illuminated by one of the lighting devices described herein.

The present invention may be more fully understood with reference to the accompanying drawings and the following detailed description of the invention.

BRIEF DESCRIPTION OF THE DRAWING FIGURES

DETAILED DESCRIPTION OF THE INVENTION

Figure 1:
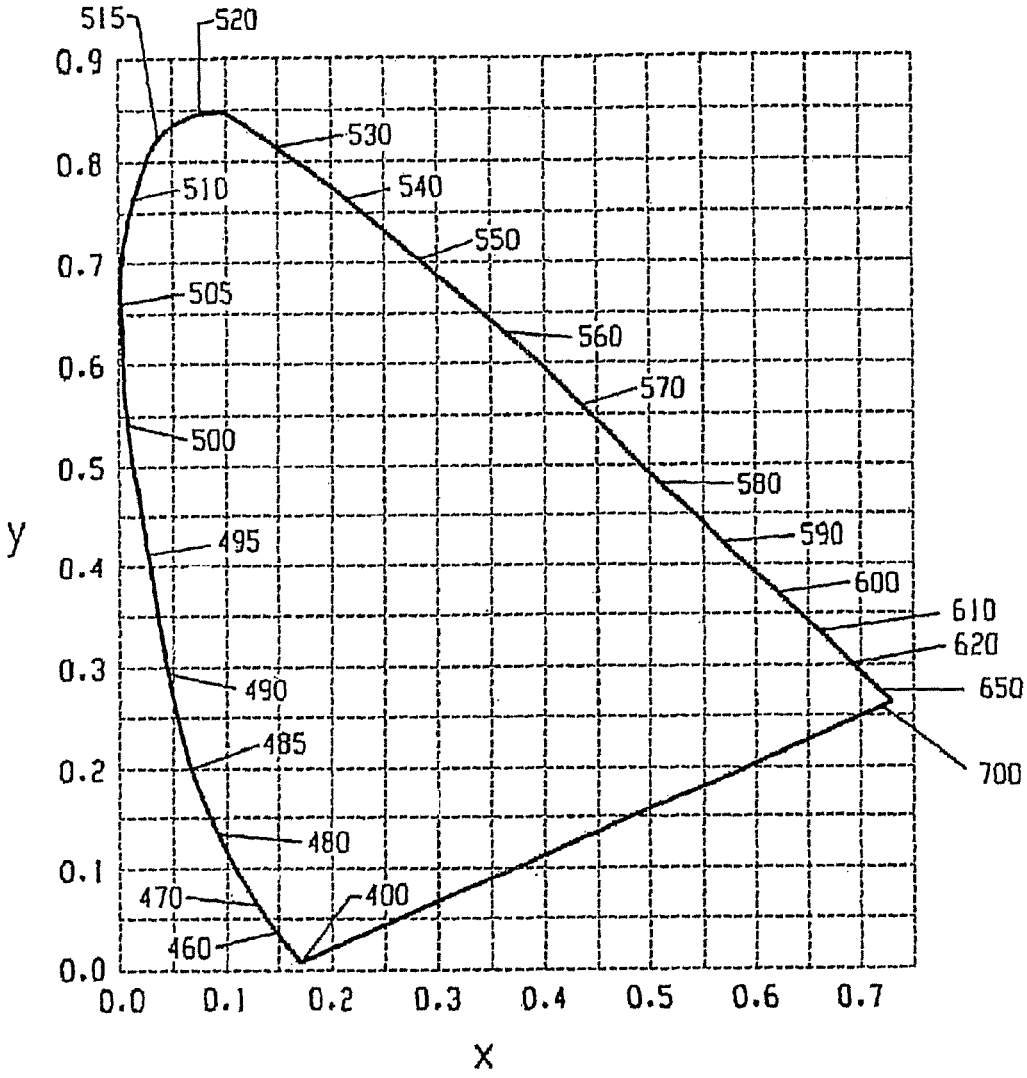
FIG. 1 shows the 1931 CIE Chromaticity Diagram.
Figure 2:
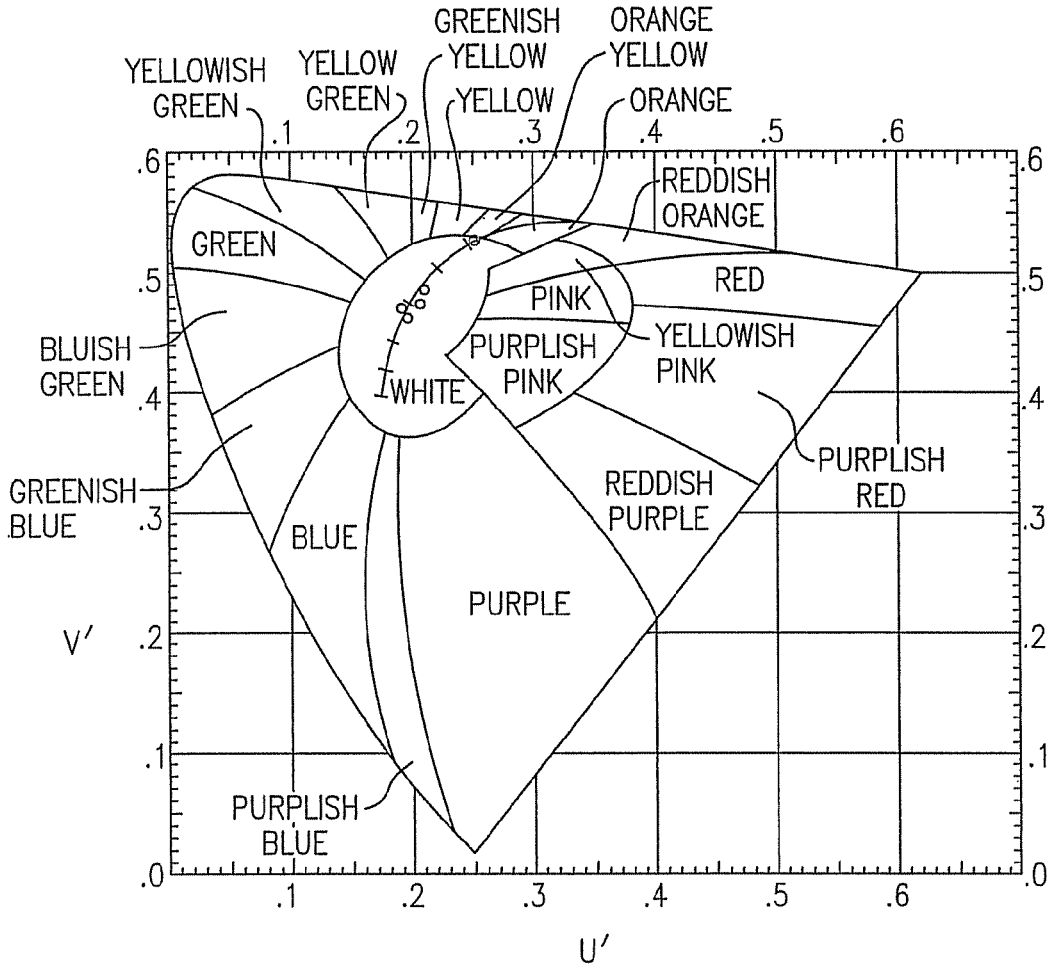
FIG. 2 shows the 1976 Chromaticity Diagram.
Figure 3:
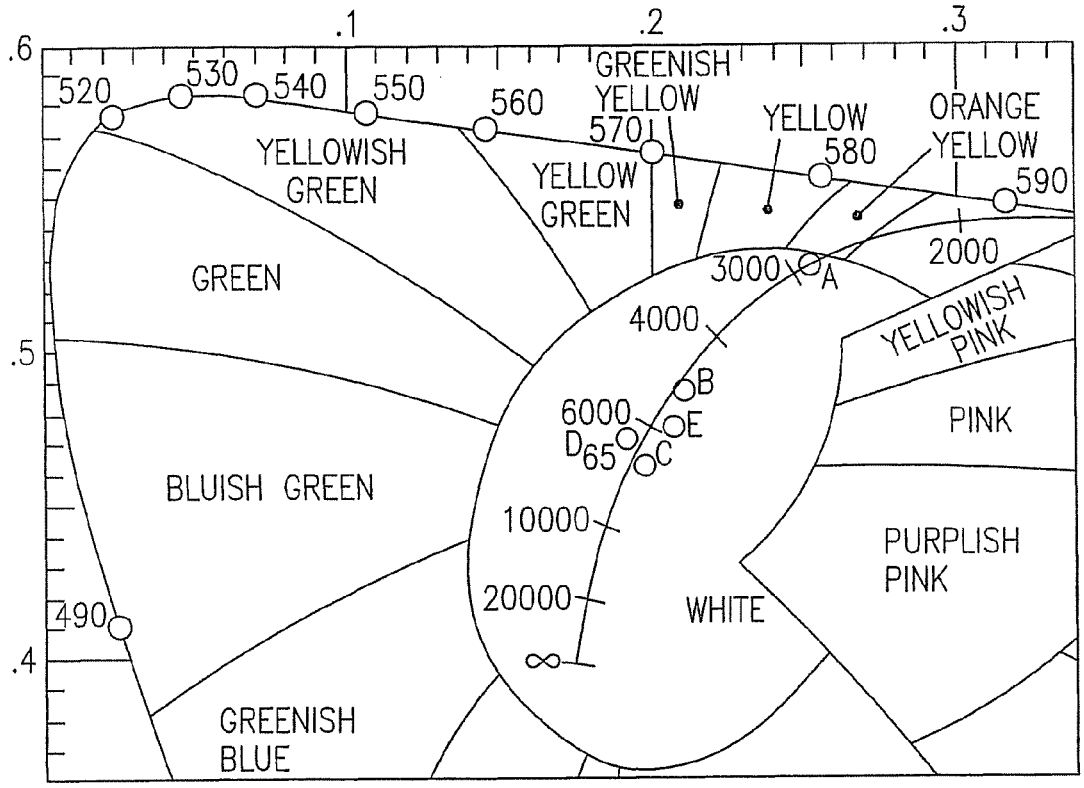
FIG. 3 shows an enlarged portion of the 1976 Chromaticity Diagram, in order to show the blackbody locus in detail.

As noted above, in accordance with various aspects of the present invention, there is provided a sign comprising a sign structure and a plurality of sources of visible light, the sign structure having a first surface on which a display is positioned.

Persons of skill in the art are familiar with a wide variety of sign structures having surfaces on which a display is positioned, and any such structures can be employed in the present invention. Such sign structures can be made of any of a wide variety of materials, and can be in any of a wide variety of shapes. Typically, such sign structures are substantially flat, having a front surface and a rear surface, the front surface having the display positioned thereon, although the present invention is not limited to such structures. The display can include lettering (one or more letters), one or more images, etc. As noted above, the present invention can be applied to comparatively large signage, e.g., signage in which the display has a surface area of at least 4 square meters, or signage in which the display has a surface area of at least 40 square meters.

As also noted above, in accordance with various aspects of the present invention, the source or sources of visible light are each independently selected from among solid state light emitters and luminescent materials.

Any desired solid state light emitter or emitters can be employed in accordance with the present invention. Persons of skill in the art are aware of, and have ready access to, a wide variety of such emitters. Such solid state light emitters include inorganic and organic light emitters. Examples of types of such light emitters include light emitting diodes (inorganic or organic), laser diodes and thin film electroluminescent devices, a variety of each of which are well-known in the art. In a specific aspect of the present invention, relatively small light emitting diodes are employed, e.g., light emitting diodes which have an illumination surface having a surface area of not more than 0.25 $mm^2$.

As noted above, persons skilled in the art are familiar with a wide variety of solid state light emitters, including a wide variety of light emitting diodes, a wide variety of laser diodes and a wide variety of thin film electroluminescent devices, and therefore it is not necessary to describe in detail such devices, and/or the materials out of which such devices are made.

The signs according to the present invention can comprise any desired number of sources of visible light and/or any desired number of solid state emitters. For example, a lighting device according to the present invention can include 100 or more light emitting diodes, or can include 1000 or more light emitting diodes, etc (or 100 or more sources of visible light, or 1000 or more sources of visible light). In general, with current light emitting diodes, greater efficiency can be achieved by using a greater number of smaller light emitting diodes (e.g., 100 light emitting diodes each having a surface area of 0.1 $mm^2$ vs. 25 light emitting diodes each having a surface area of 0.4 $mm^2$ but otherwise being identical).

Analogously, light emitting diodes which operate at lower current densities are generally more efficient. Light emitting diodes which draw any particular current can be used according to the present invention. In one aspect of the present invention, light emitting diodes which each draw not more than 50 milliamps are employed.

The one or more luminescent materials, if present, can be any desired luminescent material. As noted above, persons skilled in the art are familiar with, and have ready access to, a wide variety of luminescent materials. The one or more luminescent materials can be down-converting or up-converting, or can include a combination of both types.

For example, the one or more luminescent materials can be selected from among phosphors, scintillators, day glow tapes, inks which glow in the visible spectrum upon illumination with ultraviolet light, etc.

The one or more luminescent materials, when provided, can be provided in any desired form. For example, the luminescent element can be embedded in a resin (i.e., a polymeric matrix), such as a silicone material or an epoxy material.

Skilled artisans are familiar with a wide variety of "white" light sources which have poor CRI, and any such sources can be used according to the present invention. For example, such "white" light sources include metal halide lights, sodium lights, discharge lamps, and some fluorescent lights.

The sources of visible light (and/or the white light sources, if employed) in the lighting devices of the present invention can be arranged, mounted and supplied with electricity in any desired manner, and can be mounted on any desired housing or fixture. Skilled artisans are familiar with a wide variety of arrangements, mounting schemes, power supplying apparatuses, housings and fixtures, and any such arrangements, schemes, apparatuses, housings and fixtures can be employed in connection with the present invention. The lighting devices of the present invention can be electrically connected (or selectively connected) to any desired power source, persons of skill in the art being familiar with a variety of such power sources.

The expression "on", e.g., as used in the preceding paragraph in the expression "mounted on", or in other expressions, means that the first structure which is "on" a second structure can be in contact with the second structure, or can be separated from the second structure by one or more intervening structures.

A statement herein that two components in a device are "electrically connected," means that there are no components electrically between the components, the insertion of which materially affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board or another medium, are electrically connected.

Representative examples of arrangements of sources of visible light, schemes for mounting sources of visible light, apparatus for supplying electricity to sources of visible light, housings for sources of visible light, fixtures for sources of visible light and power supplies for sources of visible light, all of which are suitable for the lighting devices of the present invention, are described in U.S. Patent Application No. 60/752,753, filed Dec. 21, 2005, entitled "Lighting Device" (inventors: Gerald H. Negley, Antony Paul Ven de Ven and Neal Hunter), the entirety of which is hereby incorporated by reference. Such fixtures also make it possible to integrate excellent thermal dissipation into the light fixture itself.

In such a way, according to the present invention, light sources can be distributed over the area of the heat sink or thermal element. This provides the following: the heat load is uniformly distributed upon the thermal element, therefore minimizing overall size (area and thickness (volume)), and creates a light source that is virtually unaffected by shadowing—i.e., if an object smaller than the light emitting area is placed in front of the light emitting area, only a portion of the light rays are blocked. Since the light sources follow the Huygens principle (each sources acts a spherical wave front), the viewing of a shadow is not seen, and only a slight "dimming" of the illuminated sources occurs. This is in contrast to a single filament as the entire screen would be substantially dimmed and a shadow would be present.

In accordance with an aspect of the present invention, light emitting diodes can be directly mounted to the thermal element and the thermal element can be manufactured to extend through the body of the fixture, and thermal dissipation fins can be exposed to the exterior, limiting additional thermal interfaces in the fixture design. These thermal elements can also provide mechanical integrity to the fixture.

In an alternative aspect, thermal dissipation fins can be made (cast or extruded or elsewise fabricated) as part of the fixture exterior itself. Then, the distributed light emitting diode array can be directly mounted onto the interior fixture housing, or a "light engine" consisting of the light emitting diode array can be mounted to the interior fixture housing.

Conventionally, lighting for signage such as billboards has been mounted to the bottom of the sign structure, e.g., in fixtures hung from the bottom of the sign structure on the front side, oriented such that the lights shine toward the display on the surface of the sign. In the signs according to the present invention, the sources of visible light (and/or the white light sources, if employed) can be mounted in a similar way, or can be mounted in any other suitable manner, so long as they can illuminate at least a portion of the sign. For example, if desired, the sources of visible light (and/or the white light sources, if employed) could be hung from or otherwise mounted along the top and/or one or both of the sides of the sign structure, and/or could be mounted remote from the sign structure, e.g., on a mounting frame, on the ground, etc.

In another aspect of the present invention, the sources of visible light (each of the sources of visible light being independently selected from among solid state light emitters and luminescent materials) include (1) two or more sources of visible light which, when illuminated, produce respective illuminations which, if mixed in the absence of any other light, would produce a combined illumination which would be perceived as white or near-white and/or would have color coordinates (x,y) which are within an area on a 1931 CE Chromaticity Diagram defined by four points having the following (x,y) coordinates: point 1—(0.329, 0.369); point 2—(0.329, 0.345); point 3—(0.316, 0.332); and point 4—(0.314, 0.355), i.e., the combined illumination would have color coordinates (x,y) within an area defined by a line segment connecting point 1 to point 2, a line segment connecting point 2 to point 3, a line segment connecting point 3 to point 4, and a line segment connecting point 4 to point 1, and (2) one or more additional sources of visible light which produce one or more respective additional illuminations, and the illumination from a mixture of light produced by all of such sources of visible light (i.e., (1) plus (2)) is near the blackbody locus on the 1931 CIE Chromaticity Diagram (or on the 1976 CIE Chromaticity Diagram), e.g., within ten, six or three MacAdam ellipse of at least one point on the blackbody locus. Detailed discussions of such combinations of sources of visible light, and representative examples of such combinations are included in U.S. Patent Application No. 60/752,555, filed Dec. 21, 2005, entitled "Lighting Device and Lighting Method" (inventors Antony Paul Van de Ven and Gerald H. Negley), the entirety of which is hereby incorporated by reference.

In a specific aspect of the present invention, the sources of visible light (each of the sources of visible light being independently selected from among solid state light emitters and luminescent materials) include (1) two or more sources of visible light which, when illuminated, produce respective illuminations which, if mixed in the absence of any other light, would produce a combined illumination which would be perceived as white or near-white and/or would have color coordinates (x,y) which are within an area on a 1931 CIE Chromaticity Diagram defined by the four points having the (x,y) coordinates set forth above, (2) one or more light emitting diodes each producing a cyan illumination of a wavelength in the range of from about 500 to 505 nm, and (3) one or more light emitting diodes each producing a red illumination of a wavelength in the range of from about 610 to 630 nm.

In a further specific aspect of the present invention, the one or more sources of visible light (and the white light source, if present), when illuminated, emit light having a combined intensity of at least 400 lumens. The expression "intensity" is used herein in accordance with its normal usage, i.e., to refer to the amount of light produced over a given area, and can be measured in units such as lumens or candelas.

In a further specific aspect of the present invention, the one or more sources of visible light (and the white light source, if present), when illuminated, generate light which is mixed to produce a mixed illumination which has a CRI of at least 85.

In a further specific aspect of the present invention, the one or more sources of visible light (and the white light source, if present), when illuminated, generate light which is mixed to produce a mixed illumination of a hue which is within ten MacAdam ellipses (or, in some embodiments, within six MacAdam ellipses, or, in some embodiments, within three MacAdam ellipses) of at least one point on a blackbody locus on the 1931 CIE Chromaticity Diagram.

In a further specific aspect of the present invention, at least one source of visible light is saturated.

In a further specific aspect of the present invention, each source of visible light emits light of an illumination color hue, and an intensity of at least one color hue is at least 35% of an intensity of a mixed illumination produced by mixing illumination from each of source of visible light (and the white light source, if present).

Figure 4:
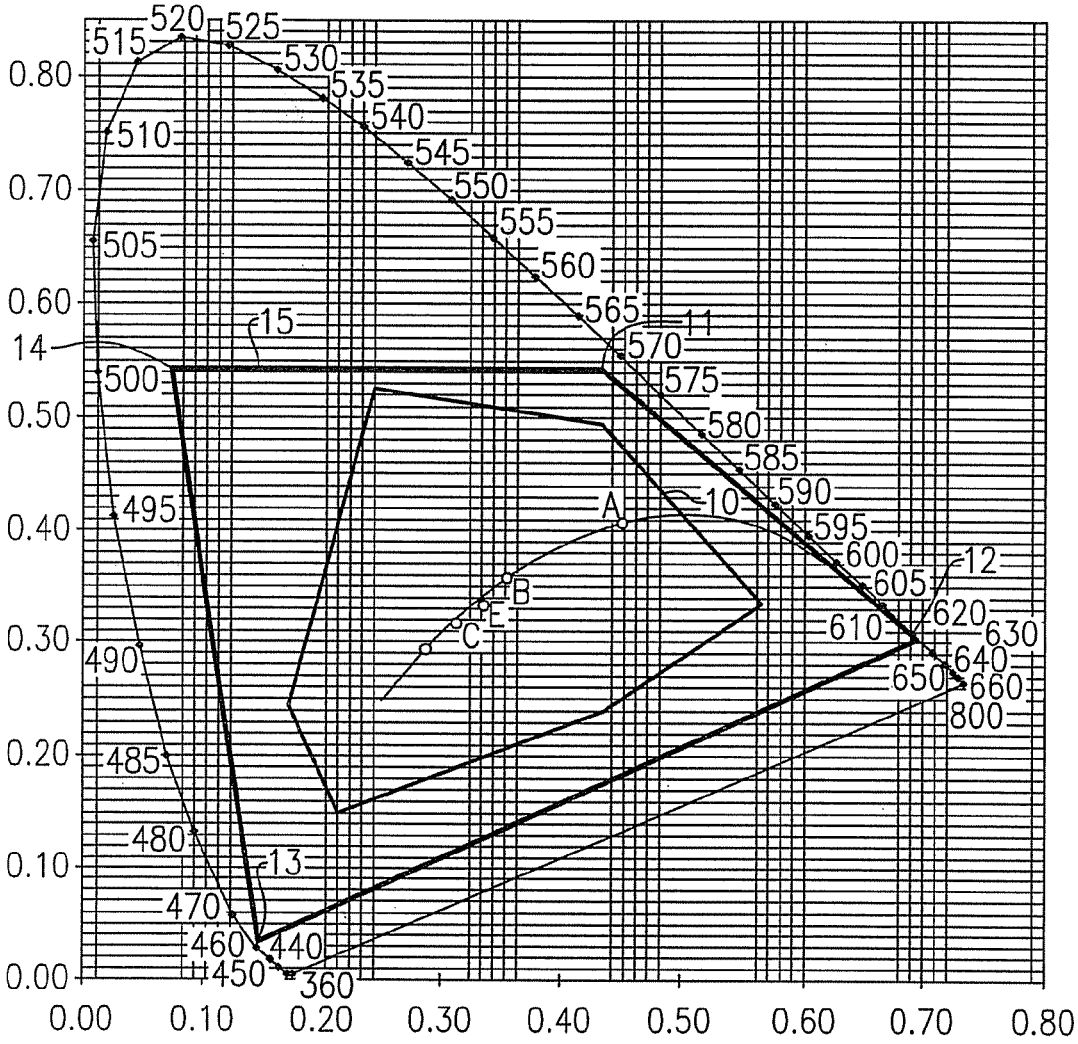
FIG. 4 depicts a color chart pertaining to a representative embodiment in accordance with the present invention.

FIG. 4 depicts a color chart pertaining to a representative embodiment in accordance with the present invention. In FIG. 4, a first shape 10 depicts the coloring of a display on a billboard. The billboard includes a first set of phosphors which, upon excitation, emit light having x,y coordinates depicted by reference number 11 (point 1), a first set of light emitting diodes which emit light having x,y coordinates depicted by reference number 12 (point 2), a second set of light emitting diodes which emit light having x,y coordinates depicted by reference number 13 (point 3), and a third set of light emitting diodes which emit light having x,y coordinates depicted by reference number 14 (point 4). As shown in FIG. 4, by inserting a first line segment connecting point 1 to point 2, a second line segment connecting point 2 to point 3, a third line segment connecting point 3 to point 4, and a fourth line segment connecting point 4 to point 1, there is obtained a shape 15 which fully encompasses the shape 10. Accordingly, the gamut of the color of the light emitted by the light emitting diodes and the phosphors fully encompasses the gamut of the coloring of the display, whereby excellent rendering (color index and contrast) of the indicia on the billboard can be provided.

Figure 5:
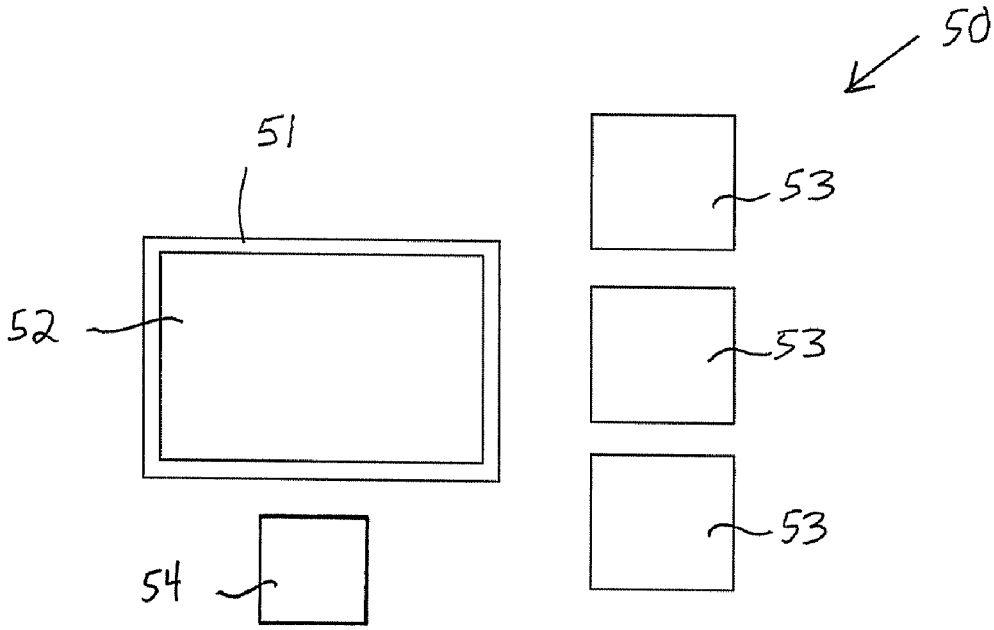
FIG. 5 is a schematic block diagram of a sign in accordance with the present inventive subject matter.

FIG. 5 is a schematic block diagram of a sign 50 comprising a sign structure 51, a plurality of sources of visible light 53 and a cooling device 54. The sign structure has a surface on which a display 52 is provided.

As indicated above, light sources according to the present invention can utilize specific color "blending" of light sources of specific (x,y) color chromaticity coordinates. (see U.S. Patent Application No. 60/752,555, filed Dec. 21, 2005, entitled "Lighting Device and Lighting Method" (inventors: Antony Paul Van de Ven and Gerald H. Negley)). Depending on the printed source colors (billboards) for example, very high color rendering can be achieved (CRI>90) as compared to the existing technology (CRI=65). Other signage types, such as green/white roadway signage can be "contrast enhanced" by using a spectrum of white light that has a large "green component". Although the overall CRI may be low, the illuminated results can show greater contrast as per the lumen count.

In addition, the present invention can provide further benefits, such as no limit to orientation of the light source (metal halide filaments must be oriented in a particular direction or face premature failure), and avoidance or reduction of shadowing effect (due to distributed light source).

The devices according to the present invention can further comprise one or more long-life cooling device (e.g., a fan with an extremely high lifetime). Such long-life cooling device(s) can comprise piezoelectric or magnetorestrictive materials (e.g., MR, GMR, and/or HMR materials) that move air as a "Chinese fan". In cooling the devices according to the present invention, typically only enough air to break the boundary layer is required to induce temperature drops of 10 to 15 degrees C. Hence, in such cases, strong "breezes" or a large fluid flow rate (large CFM) are typically not required (thereby avoiding the need for conventional fans).

The devices according to the present invention can further comprise secondary optics to further change the projected nature of the emitted light. Such secondary optics are well-known to those skilled in the art, and so they do not need to be described in detail herein—any such secondary optics can, if desired, be employed.

The devices according to the present invention can further comprise sensors or charging devices or cameras, etc. For example, persons of skill in the art are familiar with, and have ready access to, devices which detect one or more occurrence (e.g., motion detectors, which detect motion of an object or person), and which, in response to such detection, trigger illumination of a light, activation of a security camera, etc. As a representative example, a device according to the present invention can include a lighting device according to the present invention and a motion sensor, and can be constructed such that (1) while the light is illuminated, if the motion sensor detects movement, a security camera is activated to record visual data at or around the location of the detected motion, or (2) if the motion sensor detects movement, the light is illuminated to light the region near the location of the detected motion and the security camera is activated to record visual data at or around the location of the detected motion, etc.

In accordance with additional aspects of the present invention, there are provided methods in which a sign is illuminated by one of the lighting devices described herein.

Any two or more structural parts of the lighting devices described herein can be integrated. Any structural part of the lighting devices described herein can be provided in two or more parts (which can be held together, if necessary).

The invention claimed is:

1. A sign, comprising:

a sign structure having a first surface, a display on said first surface, said display comprising at least one display color hue, each said display color hue having x,y coordinates on a 1931 CIE Chromaticity Diagram; and a plurality of sources of visible light, said sources of visible light oriented such that when illuminated, they illuminate at least a portion of said display, said sources of visible light independently selected from among solid state light emitters and luminescent materials, each said source of visible light, when illuminated, emitting light of an illumination color hue, each illumination color hue having x,y coordinates on said 1931 CIE Chromaticity Diagram, wherein line segments drawn on said 1931 CTE Chromaticity Diagram connecting respective x,y coordinates of at least some of said illumination color hues define a shape which encompasses x,y coordinates of each of said at least one display color hue.

2. A sign as recited in claim 1, wherein said display comprises at least one letter.

3. A sign as recited in claim 1, wherein said display comprises at least one image.

4. A sign as recited in claim 1, wherein said display has a surface area of at least 4 square meters.

5. A sign as recited in claim 1, wherein said display has a surface area of at least 40 square meters.

6. A sign as recited in claim 1, wherein said sign comprises at least 100 of said sources of visible light.

7. A sign as recited in claim 1, wherein said sign comprises at least 1000 of said sources of visible light.

8. A sign as recited in claim 1, wherein said sources of visible light comprise at least one solid state light emitter.

9. A sign as recited in claim 1, wherein said sources of visible light comprise at least one light emitting diode.

10. A sign as recited in claim 9, wherein said at least one light emitting diode has an illumination surface having a surface area of not more than 0.25 $mm^2$.

11. A sign as recited in claim 1, wherein said sources of visible light comprise at least one luminescent material.

12. A sign as recited in claim 1, wherein said sources of visible light comprise at least one phosphor.

13. A sign as recited in claim 1, wherein said sources of visible light, when illuminated, emit light having a combined intensity of at least 400 lumens.

14. A sign as recited in claim 1, wherein said plurality of sources of visible light, when illuminated, generate light which is mixed to produce a mixed illumination which has a CRI of at least 85.

15. A sign as recited in claim 1, wherein said plurality of sources of visible light, when illuminated, generate light which is mixed to produce a mixed illumination which is within ten MacAdam ellipses of at least one point on a blackbody locus on the 1931 CIE Chromaticity Diagram.

16. A sign as recited in claim 1, wherein said plurality of sources of visible light, when illuminated, generate light which is mixed to produce a mixed illumination which is within six MacAdam ellipses of at least one point on a blackbody locus on the 1931 CIE Chromaticity Diagram.

17. A sign as recited in claim 1, wherein said plurality of sources of visible light, when illuminated, generate light which is mixed to produce a mixed illumination which is within three MacAdam ellipses of at least one point on a blackbody locus on the 1931 CIE, Chromaticity Diagram.

18. A sign as recited in claim 1, wherein at least one of said sources of visible light is saturated.

19. A sign as recited in claim 1, wherein an intensity of at least one of said color hues is at least 35% of an intensity of a mixed illumination produced by mixing illumination from each of said plurality of sources of visible light.

20. A sign as recited in claim 1, wherein said sign further comprises at least one long-life cooling device.

21. A sign, comprising:

a sign structure having a first surface, a display on said first surface;

a white light source having a CRI of 75 or less, said white light source oriented such that when illuminated, it illuminates at least a portion of said display; and at least one additional source of visible light, said at least one additional source of visible light oriented such that when illuminated, said additional source of visible light illuminates at least a portion of said display, said at least one additional source of visible light selected from among solid state light emitters and luminescent materials, wherein mixing of light from said white light source and light from said at least one additional source of visible light produces a mixed illumination which has a CRI of at least 85.

22. A sign as recited in claim 21, wherein said display comprises at least one letter.

23. A sign as recited in claim 21, wherein said display comprises at least one image.

24. A sign as recited in claim 21, wherein said display has a surface area of at least 4 square meters.

25. A sign as recited in claim 21, wherein said display has a surface area of at least 40 square meters.

26. A sign as recited in claim 21, wherein said sign comprises at least 100 of said sources of visible light.

27. A sign as recited in claim 21, wherein said sign comprises at least 1000 of said sources of visible light.

28. A sign as recited in claim 21, wherein said at least one additional source of visible light comprises at least one solid state light emitter.

29. A sign as recited in claim 21, wherein said at least one additional source of visible light comprises at least one light emitting diode.

30. A sign as recited in claim 29, wherein said at least one light emitting diode has an illumination surface having a surface area of not more than 0.25 $mm^2$.

31. A sign as recited in claim 21, wherein said at least one additional source of visible light comprises at least one luminescent material.

32. A sign as recited in claim 21, wherein said at least one additional source of visible light comprises at least one phosphor.

33. A sign as recited in claim 21, wherein said white light source and said at least one additional source of visible light, when illuminated, emit light having a combined intensity of at least 400 lumens.

34. A sign as recited in claim 21, wherein said white light source and said at least one additional source of visible light, when illuminated, generate light which is mixed to produce a mixed illumination which has a CRI of at least 85.

35. A sign as recited in claim 21, wherein said white light source and said at least one additional source of visible light, when illuminated, generate light which is mixed to produce a mixed illumination which is within ten MacAdam ellipses of at least one point on a blackbody locus on the 1931 CIE Chromaticity Diagram.

36. A sign as recited in claim 21, wherein said white light source and said at least one additional source of visible light, when illuminated, generate light which is mixed to produce a mixed illumination which is within six MacAdam ellipses of at least one point on a blackbody locus on the 1931 CIE Chromaticity Diagram.

37. A sign as recited in claim 21, wherein said white light source and said at least one additional source of visible light, when illuminated, generate light which is mixed to produce a mixed illumination which is within three MacAdam ellipses of at least one point on a blackbody locus on the 1931 CIE Chromaticity Diagram.

38. A sign as recited in claim 21, wherein an intensity of said white light source, when illuminated, is at least 60% of an intensity of an illumination formed by mixing illumination from said white light source and said at least one additional source of visible light.

39. A sign as recited in claim 21, wherein at least one of said at least one additional source of visible light is saturated.

40. A sign as recited in claim 21, wherein an intensity of at least one of said color hues is at least 35% of an intensity of a mixed illumination produced by mixing illumination from said white light source and from said at least one additional source of visible light.

41. A sign, comprising:

a sign structure having a first surface, a display on said first surface, said display comprising at least one display color hue, each said display color hue having x,y coordinates on a 1931 CIE Chromaticity Diagram;

a white light source having a CRI of 75 or less, said white light source oriented such that when illuminated, it illuminates at least a portion of said display; and a plurality of additional sources of visible light, said additional sources of visible light oriented such that when illuminated, they illuminate at least a portion of said display, said additional sources of visible light independently selected from among solid state light emitters and luminescent materials, each said additional source of visible light, when illuminated, emitting light of an illumination color hue, each illumination color hue having x,y coordinates on said 1931 CIE Chromaticity Diagram, wherein line segments drawn on said 1931 CIE Chromaticity Diagram connecting respective x,y coordinates of at least some of said illumination color hues define a shape which encompasses x,y coordinates of each of said at least one display color hue.

42. A sign as recited in claim 41, wherein said display comprises at least one letter.

43. A sign as recited in claim 41, wherein said display comprises at least one image.

44. A sign as recited in claim 41, wherein said display has a surface area of at least 4 square meters.

45. A sign as recited in claim 41, wherein said display has a surface area of at least 40 square meters.

46. A sign as recited in claim 41, wherein said sign comprises at least 100 of said sources of visible light.

47. A sign as recited in claim 41, wherein said sign comprises at least 1000 of said sources of visible light.

48. A sign as recited in claim 41, wherein said additional sources of visible light comprise at least one solid state light emitter.

49. A sign as recited in claim 41, wherein said additional sources of visible light comprise at least one light emitting diode.

50. A sign as recited in claim 49, wherein said at least one light emitting diode has an illumination surface having a surface area of not more than 0.25 $mm^2$.

51. A sign as recited in claim 41, wherein said additional sources of visible light comprise at least one luminescent material.

52. A sign as recited in claim 41, wherein said additional sources of visible light comprise at least one phosphor.

53. A sign as recited in claim 41, wherein said white light source and said additional sources of visible light, when illuminated, emit light having a combined intensity of at least 400 lumens.

54. A sign as recited in claim 41, wherein said white light source and said additional sources of visible light, when illuminated, generate light which is mixed to produce a mixed illumination which has a CRI of at least 85.

55. A sign as recited in claim 41, wherein said white light source and said additional sources of visible light, when illuminated, generate light which is mixed to produce a mixed illumination which is within ten MacAdam ellipses of at least one point on a blackbody locus on the 1931 Chromaticity Diagram.

56. A sign as recited in claim 41, wherein said white light source and said additional sources of visible light, when illuminated, generate light which is mixed to produce a mixed illumination which is within six MacAdam ellipses of at least one point on a blackbody locus on the 1931 CIE Chromaticity Diagram.

57. A sign as recited in claim 41, wherein said white light source and said additional sources of visible light, when illuminated, generate light which is mixed to produce a mixed illumination which is within three MacAdam ellipses of at least one point on a blackbody locus on the 1931 CIE Chromaticity Diagram.

58. A sign as recited in claim 41, wherein an intensity of said white light source, when illuminated, is at least 60% of an intensity of an illumination formed by mixing illumination from said white light source and said additional sources of visible light.

59. A sign as recited in claim 41, wherein at least one of said additional sources of visible light is saturated.

60. A sign as recited in claim 41, wherein an intensity of at least one of said color hues is at least 35% of an intensity of a mixed illumination produced by mixing illumination from said white light source and from said additional sources of visible light.

61. A method of illuminating a sign, comprising:

illuminating a sign structure with a plurality of sources of visible light, said sign structure having a first surface, a display on said first surface, said display comprising at least one display color hue, each said display color hue having x,y coordinates on a 1931 CIE Chromaticity Diagram, said sources of visible light independently selected from among solid state light emitters and luminescent materials, each said source of visible light, when illuminated, emitting light of an illumination color hue, each illumination color hue having x,y coordinates on said 1931 CIE Chromaticity Diagram, wherein line segments drawn on said 1931 CIE Chromaticity Diagram connecting respective x,y coordinates of at least some of said illumination color hues define a shape which encompasses x,y coordinates of each of said at least one display color hue.

62. A method as recited in claim 61, wherein said display comprises at least one letter.

63. A method as recited in claim 61, wherein said display comprises at least one image.

64. A method as recited in claim 61, wherein said display has a surface area of at least 4 square meters.

65. A method as recited in claim 61, wherein said display has a surface area of at least 40 square meters.

66. A method as recited in claim 61, wherein said sign comprises at least 100 of said sources of visible light.

67. A method as recited in claim 61, wherein said sign comprises at least 1000 of said sources of visible light.

68. A method as recited in claim 61, wherein said sources of visible light comprise at least one solid state light emitter.

69. A method as recited in claim 61, wherein said sources of visible light comprise at least one light emitting diode.

70. A method as recited in claim 69, wherein said at least one light emitting diode has an illumination surface having a surface area of not more than 0.25 $mm^2$.

71. A method as recited in claim 61, wherein said sources of visible light comprise at least one luminescent material.

72. A method as recited in claim 61, wherein said sources of visible light comprise at least one phosphor.

73. A method as recited in claim 61, wherein said sources of visible light emit light having a combined intensity of at least 400 lumens.

74. A method as recited in claim 61, wherein said plurality of sources of visible light, when illuminated, generate light which is mixed to produce a mixed illumination which has a CRI of at least 85.

75. A method as recited in claim 61, wherein said plurality of sources of visible light, when illuminated, generate light which is mixed to produce a mixed illumination which is within ten MacAdam ellipses of at least one point on a blackbody locus on the 1931 CIE Chromaticity Diagram.

76. A method as recited in claim 61, wherein said plurality of sources of visible light, when illuminated, generate light which is mixed to produce a mixed illumination which is within six MacAdam ellipses of at least one point on a blackbody locus on the 1931 CIE Chromaticity Diagram.

77. A method as recited in claim 61, wherein said plurality of sources of visible light, when illuminated, generate light which is mixed to produce a mixed illumination which is within three MacAdam ellipse of at least one point on a blackbody locus on the 1931 CIE Chromaticity Diagram.

78. A method as recited in claim 61, wherein at least one of said sources of visible light is saturated.

79. A method as recited in claim 61, wherein an intensity of at least one of said color hues is at least 35% of an intensity of a mixed illumination produced by illumination from said plurality of sources of visible light.

* * * * *

UNITED STATES PATENT AND TRADEMARK OFFICE

CERTIFICATE OF CORRECTION

PATENT NO. : 8,112,921 B2
APPLICATION NO. : 11/613733
DATED : February 14, 2012
INVENTOR(S) : Antony Paul Van De Ven and Gerald H. Negley It is certified that error appears in the above-identified patent and that said Letters Patent is hereby corrected as shown below:

Column 14

*Line 33*: please change "CTE" to --CIE--

Column 17

*Line 33*: please add --CIE-- after "1931"

Signed and Sealed this
Fifth Day of June, 2012

David J. Kappos

David J. Kappos
*Director of the United States Patent and Trademark Office*